United States Patent [19]

Schreder

[11] Patent Number: 4,766,290

[45] Date of Patent: Aug. 23, 1988

[54] SEALED ELECTRIC HOTPLATE

[75] Inventor: Felix Schreder, Oberderdingen, Fed. Rep. of Germany

[73] Assignee: E.G.O. Elektro-Gerate Blanc u. Fischer, Fed. Rep. of Germany

[21] Appl. No.: 900,781

[22] Filed: Aug. 27, 1986

[51] Int. Cl.[4] ..... H05B 3/70

[52] U.S. Cl. ..... 219/458; 219/457; 219/463; 219/451; 219/448

[58] Field of Search ..... 219/457, 458, 459, 460, 219/461, 463, 451, 445, 433, 443, 466, 446, 448, 452

[56] References Cited

U.S. PATENT DOCUMENTS

| | | | |
|---|---|---|---|
| 1,093,754 | 4/1914 | Ball | 219/458 |
| 2,101,110 | 12/1937 | Thornton | 219/445 |
| 2,664,492 | 12/1953 | Fischer | 219/457 |
| 2,727,133 | 12/1955 | Scofield | 219/463 |
| 3,016,444 | 1/1962 | Jasionowski | 219/451 |
| 3,300,621 | 1/1967 | Fischer | 219/457 |
| 3,327,095 | 6/1967 | Hanson | 219/451 |
| 3,561,020 | 2/1971 | Fritzche | 4/634 |
| 3,612,829 | 10/1971 | Evans | 219/460 |
| 3,838,249 | 9/1974 | Detterbeck | 219/460 |
| 4,348,581 | 9/1982 | Fischer et al. | 219/460 |
| 4,394,565 | 7/1983 | Dills | 219/433 |
| 4,490,603 | 12/1984 | Fischer et al. | 219/463 |
| 4,491,722 | 1/1985 | Fischer et al. | 219/458 |
| 4,506,141 | 3/1985 | Scott | 219/451 |

FOREIGN PATENT DOCUMENTS

| | | | |
|---|---|---|---|
| 516910 | 9/1955 | Canada | 219/461 |
| 1021967 | 6/1958 | Fed. Rep. of Germany | 219/457 |
| 1130574 | 5/1962 | Fed. Rep. of Germany | 219/457 |
| 2909776 | 9/1980 | Fed. Rep. of Germany | 219/467 |
| 1531091 | 6/1968 | France | 219/463 |
| 1341753 | 12/1973 | United Kingdom . | |

OTHER PUBLICATIONS

Chromalox Electric Range Units, Bulletin RU-149, Edwin L. Wiegand Co., 7500 Thomas Blvd., Pittsburgh 8, PA, 9/22/50.

*Primary Examiner*—H. Broome
*Assistant Examiner*—Terese J. Walberg
*Attorney, Agent, or Firm*—Steele, Gould & Fried

[57] ABSTRACT

A sealed electric hotplate is to be provided, which can be simply fitted by lateral insertion into a hob. For this purpose a hotplate with a cast metal body is surrounded by a very wide trim ring, which is provided with centering projections. The wide ring is separately grounded, in that a grounding line is provided between the trim ring or the hotplate body or the plug-in connection.

21 Claims, 8 Drawing Sheets

FIG. 8
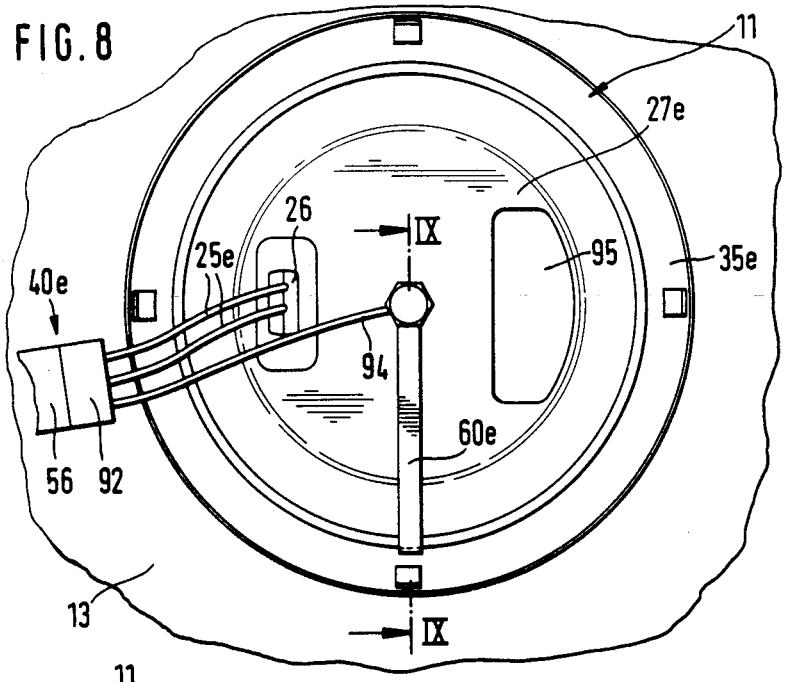
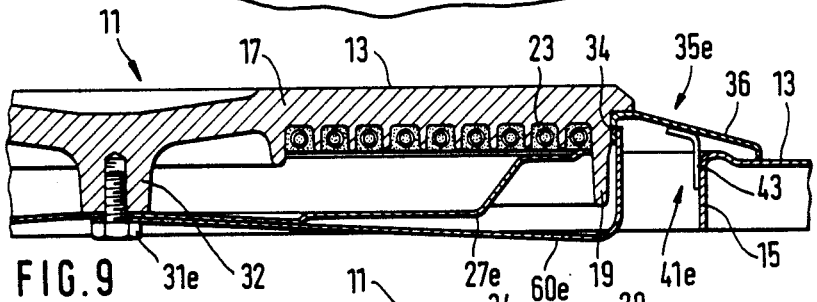
FIG. 9
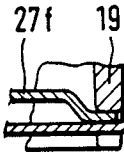
FIG. 10
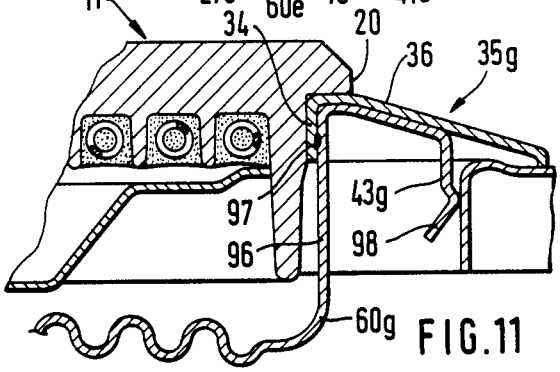
FIG. 11

SEALED ELECTRIC HOTPLATE

BACKGROUND OF THE INVENTION

1. Field of the Invention

The invention relates to electric hotplates with a hotplate body having a sealed cooking surface, which is generally made from cast iron and is provided on its underside with heating resistors in the form of wire coils received in ribs in an embedding material (cf U.S. Pat. No. 3,300,621).

2. Description of the Prior Art

The cast iron hotplate body of such hotplates is normally surrounded by a pressed on sheet steel trim ring, which has an inverted U or V-shape. They are fitted into the mounting opening of a mounting plate or cooking hob, in that the trim ring is placed on the mounting plate and the hotplate is braced downwards by a clamp (U.S. Pat. Nos. 1,093,754, 2,664,492, British Pat. No. 1 341 753 and DE-OS No. 29 09 776). The connection to a power supply is normally by means of screwed down flexible lines (U.S. Pat. No. 4,348,581). However, hotplates with plug-in connections are also known, which are inserted from above in connector sockets (German Pat. No. 1 021 967).

Wide trim rings are known for use in connection with glass cooking hobs, in order protect the glass plate from the hotplate temperature and for this purpose shielding rings are also provided (U.S. Pat. No. 4,490,603).

Clamps acting in the edge region are frequently used for securing the hotplates (DE-AS No. 1 130 574, U.S. Pat. No. 3,561,020). If in the case of glass mounting plates, the mounting openings are much larger than the diameter of the hotplate body, use has been made of centering means and in part shimmed seals (U.S. Pat. Nos. 3,838,249, 4,491,722 and U.S. patent application No. 245,541, applied for on 19.3.1981, in conjunction with Ser. No. 968,048, filed on 12.12.1978 in the name of Karl Fischer and entitled "Electric cooker plate").

However, it is also conventional practice to use hotplates which do not have a sealed cooking surface and generally comprise spirally wound tubular heaters. These are arranged in optionally interchangeable trays with edges, which rest on a mounting opening of a hob. They are connected by means of plugs fitted to the ends of the tubular heaters and these are laterally inserted into connector sockets.

OBJECT OF THE INVENTION

The object of the invention is therefore to provide a sealed hotplate, which can be easily interchanged with such open hotplates, so as to make it possible to have a hotplate, which is more reliable and safe, as well as easier to clean and into which no overflowing cooking material can penetrate. A further object of the invention is to ensure the electric safety of the hotplate, even under unfavourable conditions.

SUMMARY OF THE INVENTION

The invention provides centering means, which are connected to the trim ring and are constructed for cooperating with an inner face of the mounting opening, as well as grounding means for the trim ring. Although the conventional pressing on of the trim ring onto the hotplate body normally led to an electric contact and consequently said ring was also grounded together with the metal hotplate body, it has been found that as a result of corrosion and other unfavourable circumstances, said contact can be interrupted, despite its large area nature. This is not a problem with normal narrow rings because they could either only be rendered live from the hotplate body or from the mounting plate and both of these components are grounded. However, in the case of a very wide ring, it was possible for an electric lead to come into contact with the trim ring from the inside of the cooker and consequently render the same live. Therefore the invention provides grounding for said edge, in order to ensure electric safety, even in the case of fitting with a wide rim.

As a result of horizontally arranged plug connection, a a sealed plug-in hotplate unit is obtained, which can easily be employed by the user in place of the open hotplate unit.

The invention is described hereinafter relative to an embodiment.

BRIEF DESCRIPTION OF THE DRAWINGS

FIG. 8, a view from below of a hotplate.

FIG. 9, a partial section along line IX in FIG. 8.

FIGS. 10 and 11, details of slightly modified embodiments.

DETAILED DESCRIPTION OF THE PREFERRED EMBODIMENTS

Figure 1:
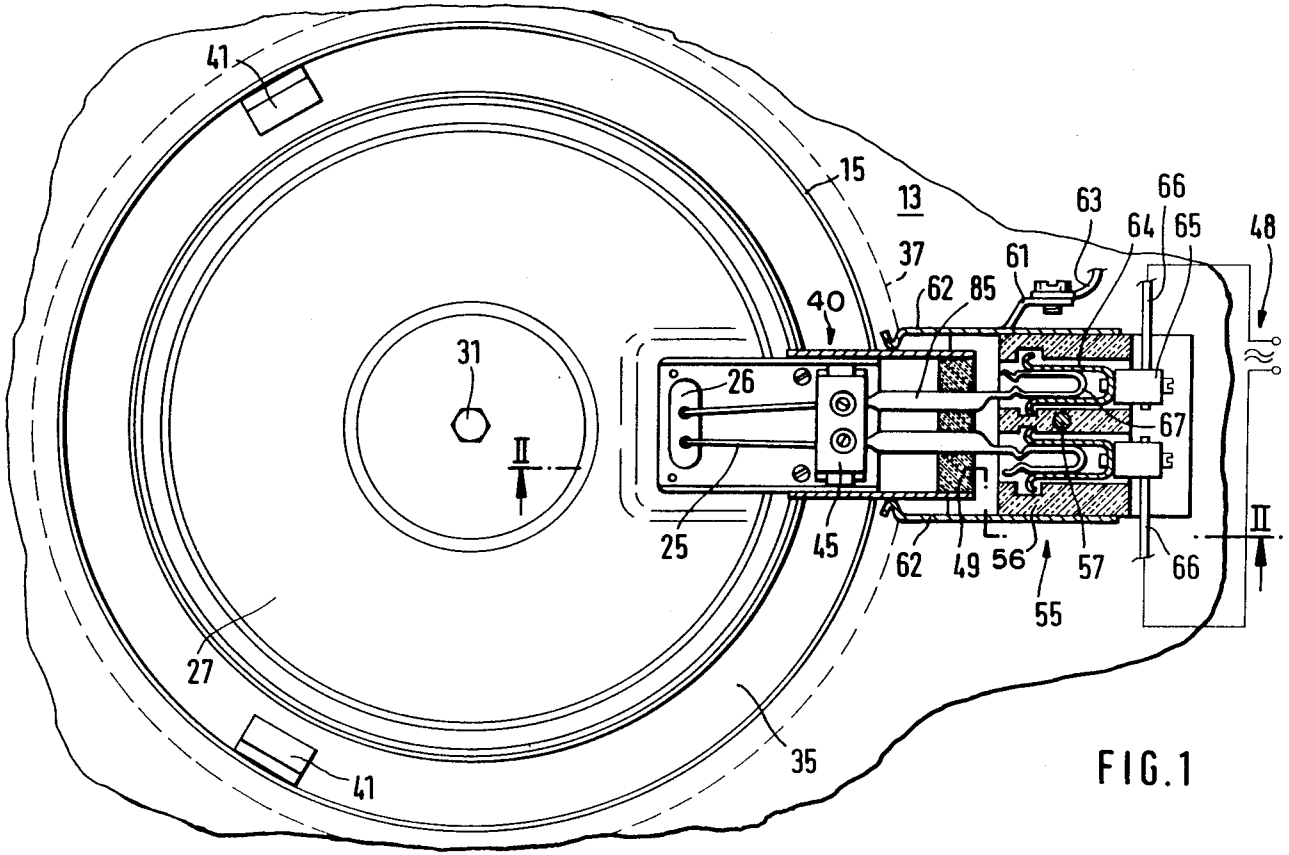
FIG. 1, shows a part sectional view from below of a hotplate.
Figure 2:
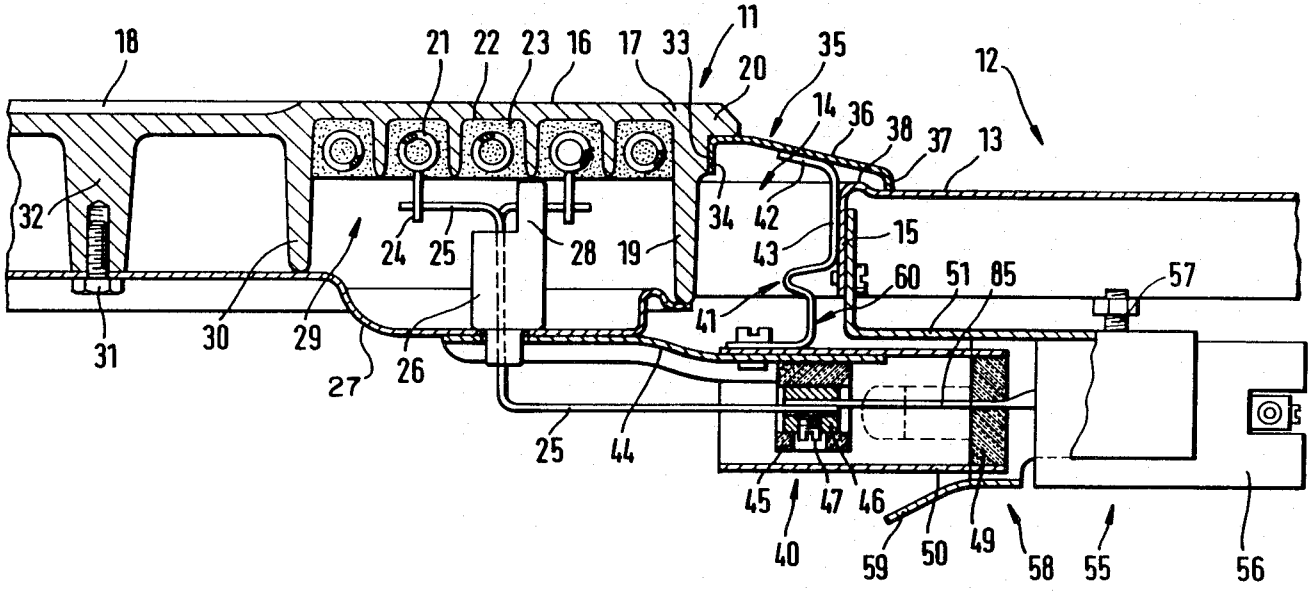
FIG. 2, shows a partial section along line II.

FIGS. 1 and 2 show an electric hotplate 11, fitted in a cooking hob 12, of which the upper mounting plate 13 in the form of a sheet metal plate whose surface is normally enamelled is shown. It has a mounting opening 14, which is surrounded by a downwardly directed edge or rim 15 of mounting plate 13.

An electric hotplate 11 with a sealed planar cooking surface 16 is fitted into mounting opening 14. Hotplate body 17 is made from cast iron and is in the form of a relatively thin-walled plate, whose upper cooking surface 16 surrounding a somewhat recessed central zone 18 in ring-like manner is faced. The hotplate body is provided on its outer circumference with an upper edge flange 20 and a flange-like, downwardly projecting, substantially cylindrical outer edge 19 connecting onto the same. The annular cooking surface 16 is heated from below by electric heating resistors 21, which comprise wire coils, which are located in spiral slots 22 in an electrically insulating, pressed-in, embedding material 23. Their terminals 24 in the form of pins project out of the embedding material 23 are welded to solid lead wires 25, which pass through a bushing 26 made from heatproof insulating material which is guided by a cover plate 27 closing the underside of the hotplate and is pressed by projections 28 against the underside of the hotplate.

Cover plate 27 rests on a downwardly projecting inner edge inwardly bounding the heated zone 29 and is fixed by a screw 31, which is screwed in a central cast metal projection 32 projecting downwards in the unheated central zone 18 of the hotplate.

Below the edge flange 20 on the outer face of outer edge 19 is provided a cylindrically turned reception section 33, to which is fixed by pressing on a substantially cylindrical inner section 34 of a mounting or trim ring 35 made from enamelled or stainless sheet steel. Its very wide central section 36 inclined outwards under a very small angle of preferably between 5° and 10°, e.g. 7° is supported on the underside of edge flange 20 and terminates on the outside in a more steeply downwardly directed outer edge 37, which rests on the surface of mounting plate 13 close to the mounting opening and surrounds the latter. An upwardly directed bead 38 of the mounting plate surrounds mounting opening 14 and prevents liquid from running into the latter.

The edge or rim, which can have a total width of 1.5 to 3 cm (3/5 to 1 1/5 inch), preferably approximately 2 cm (4/5 inch), covers a relatively large spacing between the hotplate body 17 or its outer rim 19 and the opening rim 15 of the mounting plate. This spacing is only slightly less than the width of the trim ring 35. It is therefore possible to introduce the hotplate from above into the mounting opening 14 in such a way that its connection 40 can be moved laterally below the mounting plate and this spacing also acts in an insulating manner and prevents significant heating of mounting plate 13.

The hotplate is centered in the mounting opening 14 by special centering means 41. In the embodiment, they comprise three clips uniformly distributed around the mounting ring circumference and fixed to its lower face by spot welding, said clips having a fixing portion 42 and a downwardly directed centering portion 43, which cooperates with the inner face of the opening edge 15. The centering means can be constructed so resiliently that they bring about a certain clamping action on the inner face of the opening edge.

Connection 40 has a fixing plate 44 fixed to the cover plate 27 by spot welding or screwing and through which the bushing 26 partly projects and which projects substantially horizontally over the hotplate on one side. Close to its outer end, it carries an insulating material connecting piece 45, which contains screw fixing sleeves 46 for the lead wires 25, which pass out of the bushing and run parallel to the fixing plate 44. Within the screw fixing sleeves, the lead wires are conductively locked by screws 47 to conductors 85 comprising sheet metal strips and which pass through an insulating material guide part 49 at the free end of a connecting housing 50.

The connecting housing 50 is a sleeve having a rectangular cross-section bent together from a sheet metal strip, said sleeve surrounding the connecting piece 45 and the connecting housing 50 and with a substantially horizontal axis projects radially outwards and downwards over the end of fixing plate 44. Fixing plate 44 projecting into connecting housing 50 is screwed thereto, whilst interposing a grounding means 60, which comprises a sheet metal strip bent in S-shaped manner to improve the spring action and connected to one of the centering portions 43. Therefore the trim ring 35 is safely electrically conductively connected to the connecting housing 50, contacted on both sides by grounding clips 62 of a connecting member 55 screwed to a fixing clip 51 on the opening ring 15 and mechanically and electrically connected in this way to the mounting plate. Member 55 contains an insulating material connecting socket 56, connected by means of a guide screw 57 so as to have a limited movement in the vertical direction with a socket housing 58, which has the fixing clip 51, grounding clip 62 and a lower insertion bevel 59. The socket plate has a grounding connection 61 to which is screwed a grounding line 63.

Connecting socket 56 contains U-shaped or tulip-shaped bushes 64 made from a resilient material and which are connected to screw connection bushes 65, to which are connected the two connecting leads 66 of the hotplate, which lead by means of a not shown control device to a domestic power supply 48.

The strip-like leads 85 are turned by 90° at their ends projecting out of guide piece 49 and are shaped to form a resilient plug-in connecting pin 67, by being bent in U-shaped manner and provided with two inwardly directed, facing corrugations, which can be supported against one another and therefore maintain resilient tension even in the case of higher contact pressures. The connecting pins 67 together with the bushes 64 form a good contacting plug connection. Connecting housing 50 together with the guide piece 49 ensure that the pins are sufficiently rigid to permit insertion into the bushes and namely through a substantially horizontal movement of the entire hotplate, whilst tilting slightly downwards. The length of connection 40 and the position of connecting member 55 are such that the hotplate is correctly centered in the mounting opening 14 when the plug connection 64, 67 is in its coupling position.

The remaining drawings show modifications of the embodiment described relative to FIGS. 1 and 2 and which could be advantageous for certain applications. Hereinafter only the differences compared with the embodiment of FIGS. 1 and 2 will be described and the same parts will be given the same reference numerals. Parts with a comparable construction and function are followed by a reference letter. The previous description also applies here. Therefore the features of the first embodiment can also be advantageously used with the other embodiments.

Figure 3:
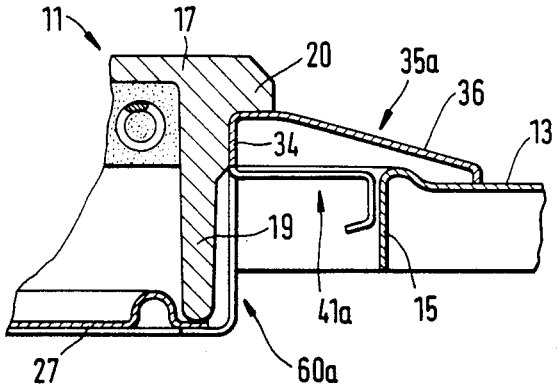
FIGS. 3 to 5, vertical partial sections through hotplate units of further preferred embodiments.

FIG. 3 shows a construction of a trim ring 35*a* which, whilst having otherwise an identical construction to the trim ring 35 shown in FIG. 2, is shaped with its centering means 41*a* in one piece on the inner portion 34. The centering means form clips bent outwards in L-shaped manner on a number of occasions on the circumference for cooperating with the opening edge 15. On the inner portion 34 is also shaped an L-shaped, downwardly directed grounding clip 60*a*, which is conductively connected to the cover plate 27 by spot welding or screwing.

Figure 4:
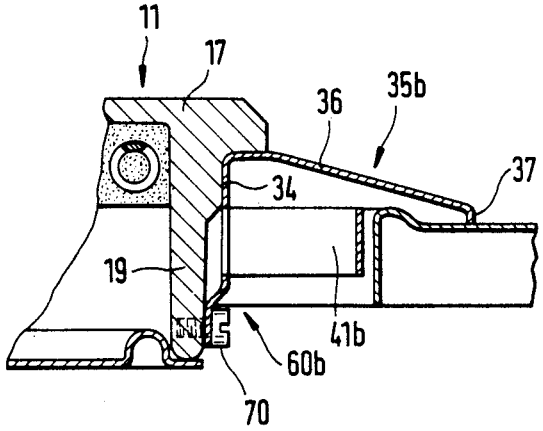
Figure 5:
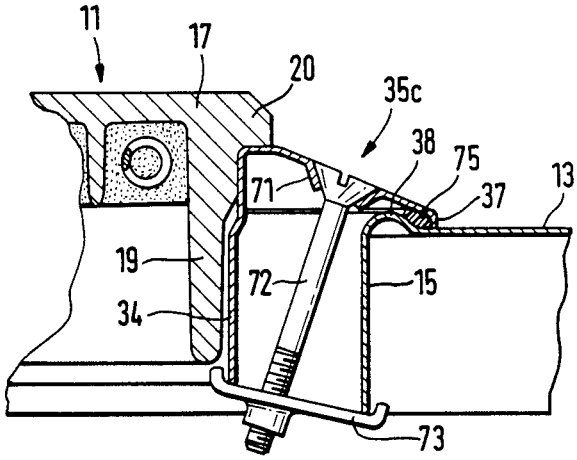

FIG. 4 shows a construction of a trim ring 35*b* largely corresponding to FIG. 3, in which once again centering and grounding means are connected in one piece to the ring. However, therein the centering means 41*b* is shaped from a sheet metal strip of the trim ring material, bent in bow-shaped manner from the circumferential direction and therefore runs in a different plane as compared with FIG. 3. Here again a grounding clip 60*b* is provided, which is conductively connected by means of a screw 70 to the rim 19 of hotplate body 17. According to FIGS. 1 and 2, its grounding is ensured by means of the central screw 31, support plate 44 and connecting housing 50.

Whereas the hotplate according to FIGS. 1 and 2 is held in the mounting opening 14 by its own weight and the plug connection, it may be desirable to fix the hotplate to mounting 13, so that the cooker can e.g. be securely transported. At two or more points on its circumference, trim ring 35c has downwardly formed depressions 71 for a flat-head screw 72, which is screwed in sloping manner from above into a clamp 73. The latter is supported on the lower edge of the substantially cylindrical inner portion 34 extended over and beyond outer rim 19 and the lower edge of the opening rim 15, so that by insertion and tightening of screws 72, the hotplate can be firmly secured from above against mounting plate 13, even if it is not accessible from the bottom. However, if this is to be the case, it is possible to use clamp bolts fixed to the underside of the trim ring and they can then be tightened from the bottom. A seal 75 in the form of a heat-resistant sealing ring or gasket is placed between bead 38 and the outer edge 37 of trim ring 35c and is secured there. It prevents the penetration of moisture, even if there should be larger liquid quantities on the mounting plate.

Figure 6:
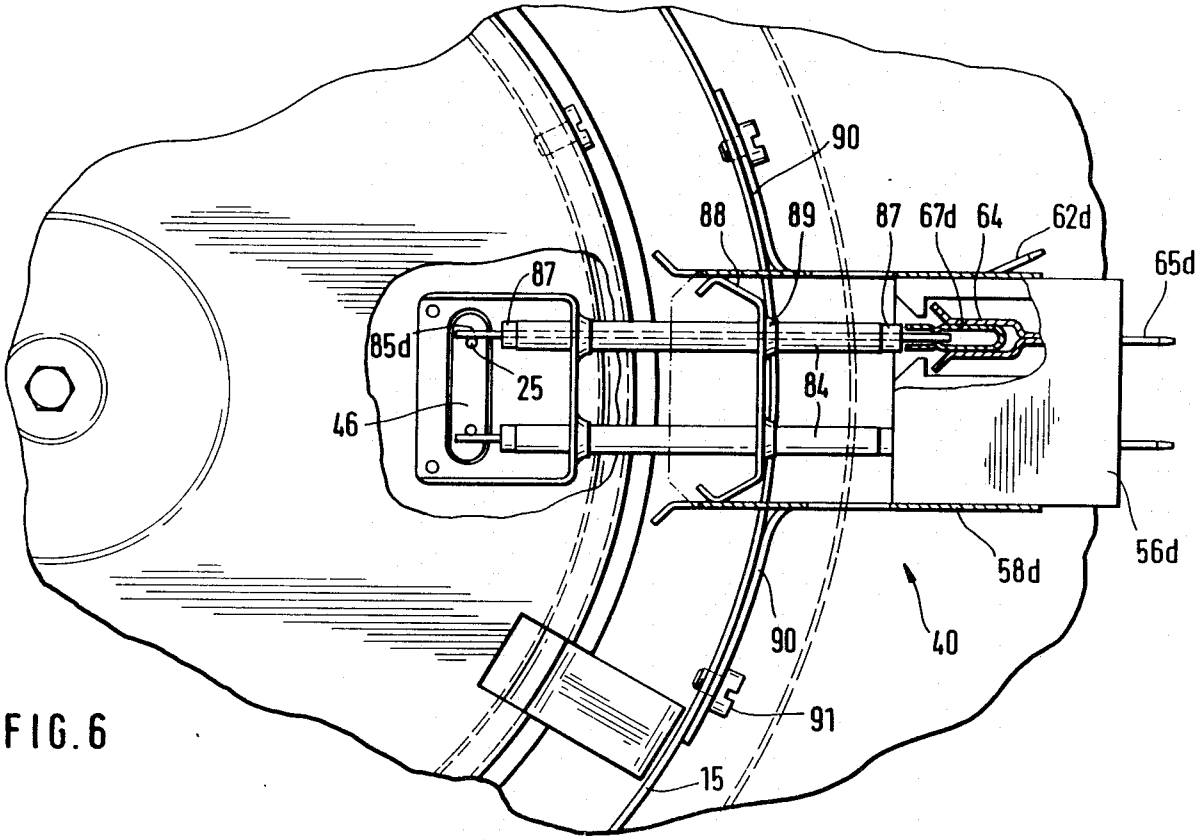
FIG. 6, a partial section along line VI in FIG. 7.
Figure 7:
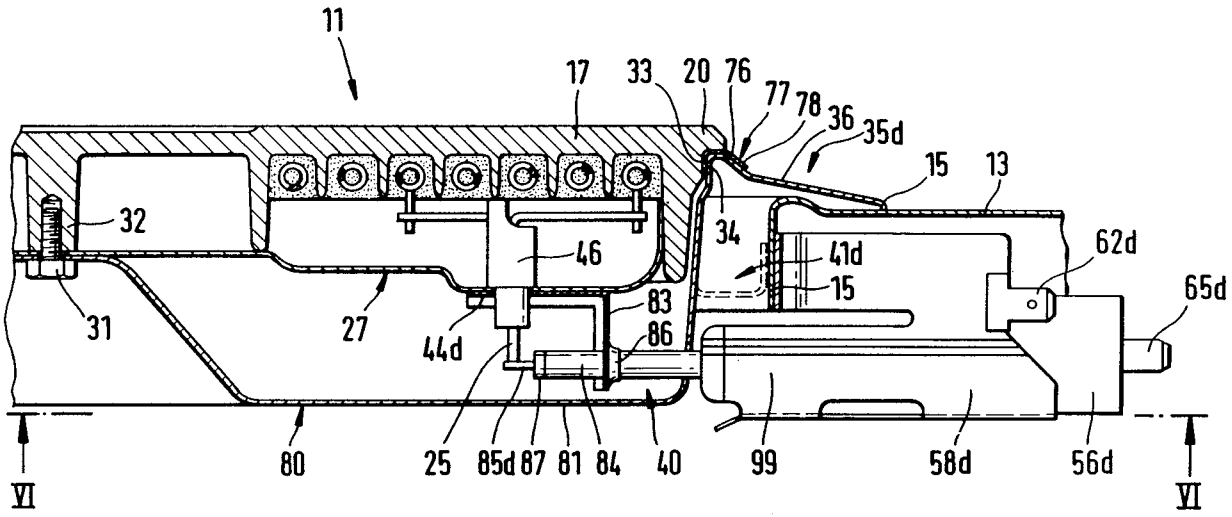
FIG. 7, a vertical partial section through part of the hotplate and the mounting plate.

FIGS. 6 and 7 show a hotplate 11, which differs as regards its connection 40 and the trim ring with centering and grounding from the embodiment of FIGS. 1 and 2. Trim ring 35 is provided, following onto its central portion 36, with an upwardly pointing bead 76, which is placed in the lower recess of a circumferential ring 77 made from thin, stainless steel sheeting. This circumferential ring is pressed onto the reception surface 33 of hotplate body 17, is supported on the underside of flange 20 and has a very narrow, downwardly sloping outer portion 78. Its total width is only 5 to 10 mm (preferably 8 mm) and only projects 3 to 7 mm (preferably 5 mm) over the edge flange 20. Such a circumferential edge or rim is standard for other hotplate mounting types. Due to its cooperation with the trim plate 35, it is also possible to use a hotplate for the described advantageous mounting form.

To trim ring 35d is connected a reception tray 80 made from the sheet material, whose outer edge in an extension of inner portion 35 runs substantially cylindrically and whose bottom downwardly covers the connecting parts. In the vicinity of a central bulge, the reception tray is electrically conductively screwed by screw 31 to the projection 32 of hotplate body 17. A sheet metal flap is stamped and bent out from the outer rim of tray 80, runs in L-shaped manner outwards and upwards and forms a centering means 41d. Thus, on part of the trim ring 35d, reception tray 80 forms the centering means 41d and the earthing of the trim ring and adequately covers the live parts of the hotplate.

Bushing 46 projects through an L-shaped fixing plate 44d, whose edges are stiffened by bends and through whose downwardly projecting L-legs 83 project guide tubes 84 and are welded there in the vicinity of sleeves 86 drawn out of the material of guide plate 44d. The guide tubes 84 are stainless steel tubes with front and rear insulating plugs 87, which are filled with an insulating embedding material. Solid connecting leads 85d project longitudinally through them and are welded to the leads 25. At a distance from the free end thereof, a grounding clip 88 is placed on the two parallel guide tubes 84 and is also welded in the vicinity of sleeves 89. The clip has lateral resilient arms engaging on the inner face of a socket sheet metal housing 58d and form a conductive grounding connection. The group clip also provides a mechanical connection between the guide tubes and reinforces the connection, so as to permit the problem-free insertion of the plug-in connecting pins welded to the free end of leads 85d. Pins 67d are U-shaped sheet metal parts with an upper constriction welded to the outside of the connecting lead 85d. They can be inserted in bushes 64d, which are arranged in the connecting socket 56d and run out into plug-in connecting lugs 65d, which project from socket 56d and on which can be mounted the connecting lines. A grounding connecting lug 62d is provided on the side.

The socket sheet metal housing 58d is substantially U-shaped and substantially receives the connecting socket 56d. The lateral faces 99 cooperating with the arms of the grounding clip 88 have lateral and lower insertion bevels. The upper portion of the lateral faces runs out in laterally sloping, bent away connecting clips 90, which are screwed by screws 91 to the inside of opening rim 15. The guide tubes provide a mechanical reinforcement and electrical insulation of the connecting leads, which can therefore serve as a plug-in connection.

FIGS. 8 and 9 show electric hotplate 11 provided on its underside with a cover plate 27e, whose edge region rests on embedding material 23 and not, as in FIG. 2, on the outer edge or rim 19. Trim ring 35e has the same basic shape as in FIG. 2 and is provided on its underside with centering means 41e, which comprise L-shaped clips welded onto the underside of trim ring 35e and whose vertically downwardly directed legs form the centering portion 43. One end of an L-shaped grounding clip 60e is welded to the cylindrical inner portion 34 and the outer rim 19 thereof runs vertically downwards and then substantially parallel to cover plate 27e up to the central cast metal projection 32, where it is screwed by screw 31e in conductive manner to hotplate body 17, together with the cover plate 27e.

Connection 40e is constructed in the form of flexible connecting leads 25e, which project through bushing 26 and are combined at the end thereof in a plug 92. The latter can be plugged into a connecting socket 56 fixed to the underside of mounting plate 13, a connection also being provided for a flexible grounding line 94, electrically conductively connected to the hotplate body by screw 31e. In this construction, the hotplate can be connected in such a way that firstly the plug-in connection is inserted, which can be made twist-proof by a corresponding design of the not shown connecting pins and the reception thereof and then the hotplate is placed in the mounting opening.

During transportation, a depression 95 in the cover plate 27e can receive the connecting socket 92, so that space-saving stacking is possible.

FIG. 10 shows that the grounding clip 60e in FIG. 9 can be passed through a recess in outer rim 19, so that grounding clip 60f does not downwardly increase the hotplate dimensions or cause any other disturbance. Cover plate 27f is also located in the vicinity of the lower rim edge and can be provided with an inward stamping at this point.

FIG. 11 shows a construction corresponding to FIG. 9, in which the grounding clip 60g is made from a corrugated sheet metal strip and is therefore longitudinally extensible. It can therefore more easily be adapted to the circumstances and there also no danger of accidental ripping out. At the end of its vertically upwardly projecting portion 96 it is connected to the inner portion 34 of trim ring 35g by a spot weld 97 and then continues on below the central portion 36 of trim ring 35g until, through a downward bend, a resilient centering portion 43g with a downwardly inwardly directed insertion bevel 98 is formed.

Figure 12:
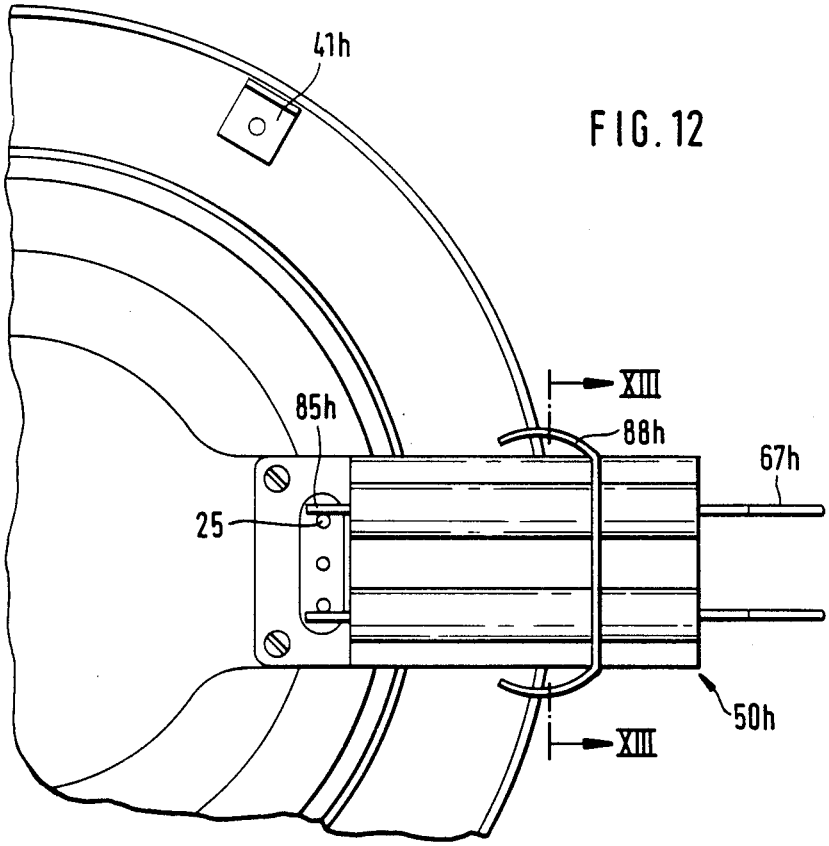
FIG. 12, a partial view from below of a hotplate.
Figure 13:
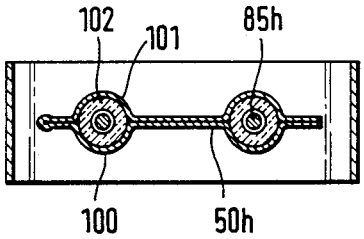
FIG. 13, a section along line XIII in FIG. 12.

FIGS. 12 and 13 show a construction in which the connecting housing **50*h* is formed from two sheet metal half-shells 100, 101, which are optionally bent together from a sheet metal part and between them form two tubular, longitudinally directed channels, in which are located e.g. steatite insulating tubes 102, in which are guided leads 85*h*. Leads 85*h* are welded to the hotplate leads 25. A grounding clip 88, corresponding to that shown in FIG. 6, is engaged and welded onto the connecting housing 50*h*. Like the remainder of the connection, it serves to cooperate with a connecting member corresponding to that shown in FIGS. 6 and 7. The plug-in connecting pins 67*h* are formed as U-shaped or tear-shaped bends of the leads 85*h* and are shown in side view in FIG. 14. Centering means 41*h* correspond to those according to FIG. 9**, but the L-leg fitted to the trim ring underside points outwards.

Figure 14:
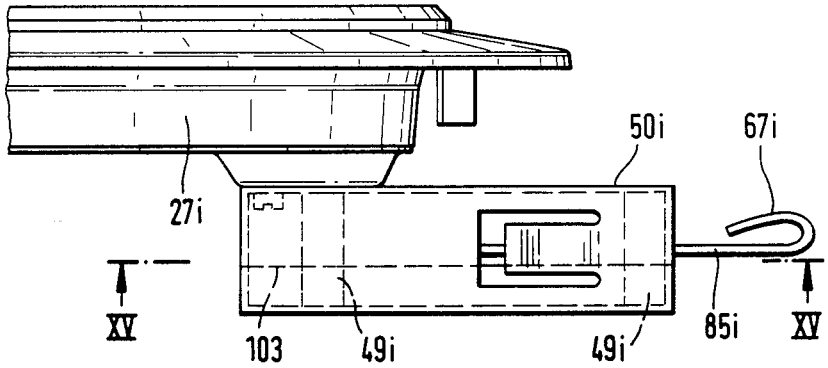
FIGS. 14 and 15, a side view and part section along line XV.
Figure 15:
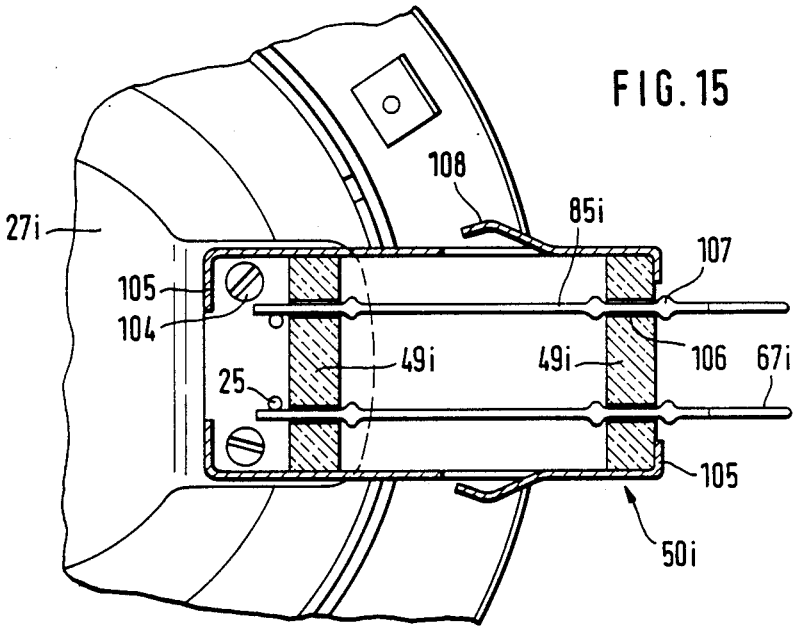

FIGS. 14 and 15 show a construction, in which the connecting housing **50*i* also fulfills the function of the fixing plate. It comprises a rectangular box, bent together from a sheet metal portion and interconnected at a longitudinal edge 103 by beading and said box is screwed by means of screws 104 to the end cover 27*i*. The narrow sides are partly closed by inwardly bent clips 105. In the interior of connecting housing 50*i* are provided two guide pieces 49*i* with maximum reciprocal spacing and through which project the two connecting leads 85*i* and which are longitudinally fixed by flat pressings 107 of the flat wire carried out upstream and downstream of the bushing openings 106. The connecting leads 85*i* made from solid, good conducting wire are welded to the hotplate connecting leads 25 and are bent round by somewhat more than 180° at their outer ends for forming plug-in connecting pins 67*i*, as can be seen in FIG. 14. Resilient clips 108 are bent out from the lateral faces of connecting housing 50*i* and form contact prongs for grounding purposes in conjunction with a connecting member, much as shown in FIG. 6**.

It is clear that as a result of the represented and described features, particularly if the combination of the wide trim ring is used together with the centering and grounding means, as well as a horizontal plug-in connection, the possibility is provided of using hotplates with a sealed surface in cookers, which were previously not intended for these.

I claim:

1. A sealed electric hotplate for fitting in a mounting opening of a mounting plate, comprising:

a hotplate body with a planar, sealed cooking surface, electric heating resistors, which are embedded in electrically insulating manner on an underside of the hotplate body and can be connected to a power supply, electric connecting means for connecting the heating resistors to a connecting member located below the mounting plate, at least one sheet metal trim ring surrounding the hotplate body and which engages on the hotplate body and whose outer edge rests on the mounting plate in the area surrounding the mounting opening, centering means connected to the trim ring and constructed to cooperate with an inner face of the mounting opening, and grounding means for the trim ring.

2. Hotplate according to claim 1, wherein the trim ring has a very flat, inverted U-shaped cross-section with a width which is several times its height and which slopes in shallow manner outwards.

3. Hotplate according to claim 1, wherein the hotplate body has an all-round, downwardly directed outer rim, which is significantly spaced from the inner face of the mounting opening.

4. Hotplate according to claim 1, wherein the centering means are clips fitted to the underside of trim ring and several of them are provided around the circumference of hotplate body.

5. Hotplate according to claim 1, wherein the centering means are integrally shaped from the material forming the trim ring.

6. Hotplate according to claim 1, wherein the centering means are resiliently constructed, so as to engage under pretension on the inner face of mounting opening.

7. Hotplate according to claim 1, wherein the connecting means project laterally over the hotplate body.

8. Hotplate according to claim 1, wherein the grounding means connect the trim ring via the connecting means and the connecting member to a grounding line.

9. Hotplate according to claim 1, wherein the grounding means conductively connect the trim ring to hotplate.

10. Hotplate according to claim 1, wherein the grounding means comprise a sheet metal strip running along the underside of hotplate.

11. Hotplate according to claim 1 wherein the grounding means are integrally formed with the trim ring.

12. Hotplate according to claim 1, wherein the grounding means are integrally constructed with at least one centering means.

13. Hotplate according to claim 1, wherein the trim ring is constructed as the rim of a tray-like component, which covers the underside of the hotplate and is conductively connected thereto.

14. Hotplate according to claim 1, wherein the plug connecting means are provided between the connecting means and the connecting member, which contain a grounding connection.

15. Hotplate according to claim 14, wherein the plug connecting means substantially act in the horizontal direction.

16. Hotplate according to claims 14, wherein the plug connecting means form a rigid plug-in member with male connecting elements connected to the hotplate body.

17. Hotplate according to claim 1, wherein the connecting means contain a housing surrounding the connecting leads.

18. Hotplate according to claim 17, wherein the connecting means are provided in the connecting housing with at least one insulating piece, through which pass the connecting leads.

19. Hotplate according to claim 1, wherein the connecting means have a connecting piece connected by means of flexible lines to the hotplate, the flexible lines containing a grounding line.

20. Hotplate according to claim 1, wherein a seal is placed between the trim ring and mounting plate.

21. Hotplate according to claim 1, wherein tensioning means act on the trim ring and tension said ring against the mounting plate.

* * * * *

UNITED STATES PATENT AND TRADEMARK OFFICE

CERTIFICATE OF CORRECTION

PATENT NO. : 4,766,290

DATED : August 23, 1988

INVENTOR(S) : Felix Schreder

It is certified that error appears in the above-identified patent and that said Letters Patent is hereby corrected as shown below:

Column 1, line 28 after "order" insert --to--.

Column 2, line 13 delete "a", second occurrence.

Column 8, line 47 delete "claims" and insert --claim--.

Signed and Sealed this

Thirteenth Day of June, 1989

*Attest:*

DONALD J. QUIGG

*Attesting Officer*

*Commissioner of Patents and Trademarks*